United States Patent [19]

Lax

[11] Patent Number: 4,930,735

[45] Date of Patent: Jun. 5, 1990

[54] BAG APPARATUS FOR SUPPORTING PLASTIC BAGS AND THE LIKE

[75] Inventor: Michael Lax, Oyster Bay Cove, N.Y.

[73] Assignee: Autronic Plastics, Inc., Westbury, N.Y.

[21] Appl. No.: 374,545

[22] Filed: Jun. 30, 1989

[51] Int. Cl.[5] ..... B65B 67/04

[52] U.S. Cl. ..... 248/101; 141/391

[58] Field of Search ..... 248/95, 97, 99, 100, 248/101, 129; 232/43.2; 383/33; 141/391, 314; 220/404, 401; 53/390

[56] References Cited

U.S. PATENT DOCUMENTS

| | | | |
|---|---|---|---|
| 1,915,020 | 6/1933 | Goldstein | 211/63 |
| 3,426,958 | 2/1969 | Gore | 248/99 X |
| 3,870,261 | 3/1975 | McSwain | 248/101 |
| 4,223,858 | 9/1980 | Salazar | 248/101 |
| 4,445,658 | 5/1984 | Ferron | 248/100 X |
| 4,497,463 | 2/1985 | Wendel | 248/101 X |
| 4,620,319 | 10/1986 | Sheehan | 383/33 |
| 4,695,020 | 9/1987 | Collins | 248/100 |
| 4,749,158 | 6/1988 | Buckley | 248/129 |
| 4,750,695 | 6/1988 | Greenhouse | 141/391 |
| 4,819,899 | 4/1989 | Weil | 248/97 |

FOREIGN PATENT DOCUMENTS

| | | | |
|---|---|---|---|
| 1410343 | 8/1965 | France | 248/99 |
| 956159 | 4/1964 | United Kingdom | 248/101 |
| 1244028 | 8/1971 | United Kingdom | 248/101 |

*Primary Examiner*—J. Franklin Foss

*Attorney, Agent, or Firm*—Ladas & Parry

[57] ABSTRACT

A bag apparatus for support on the door of a cabinet or some like supporting structure. The bag apparatus includes spaced and parallel upright sides including upper and lower portions and a detachable open frame coupling the sides and resting thereupon. The open frame defines a mouth through which a plastic bag depends, the bag having a peripheral margin adapted for being draped over the frame. A lower member extends between and is detachable from the sides. This lower member is capable of supporting the bottom of a bag draped over the frame and is further provided for supporting a source of replacement bags. A cover is pivotally connected to the sides for closing the mouth defined by the frame. The cover, sides, open frame, and lower member are detachable from one another and adapted to be packed together in a flat compact structure of nesting parts in order to conserve shelf space for marketing. The sides are provided with receptacles in which may be stored ties for closing bags which are used. U-shaped brackets are furthermore provided on the sides for further support of these ties. The receptacles moreover include protrusions with which handles on the bags maybe engaged.

17 Claims, 4 Drawing Sheets

BAG APPARATUS FOR SUPPORTING PLASTIC BAGS AND THE LIKE

FIELD OF INVENTION

This invention relates to apparatus for the support of bags in position for utilization and more particularly to bag apparatus of a knock-down structural type suitable for installation on cabinet doors and like supporting structures.

BACKGROUND

There are various known structures for holding plastic bags suitable for use in the dispensing of trash or the like. Some of the known constructions are illustrated in U.S. Pat. Nos. 3,313,504 (S. Stoltze et al) and 3,861,125 (P. Hagemeister).

In U.S. Pat. No. 3,313,504 is disclosed a frame for supporting a refuse bag of plastic foil in standing position and a freely rotatable magazine roller carrying a web consisting of a plurality of foil bags that are separable from each other by means of parallel transverse seams and tearing lines. The frame has an upper holder member for supporting the upper open part of a bag and a lower supporting member for supporting the lower closed part of the bag. The rotatable magazine roller is mounted below the lower supporting member of the frame and the lower frame member has a longitudinal opening such that the web of plastic foil bags may be pulled from the magazine roller up through the frame. The upper holder member is fixedly mounted on a frame from which it is not detachable.

In U.S. Pat. No. 3,861,125 is disclosed a bag dispensing apparatus for supporting bags sequentially fed from a roll of bags as was described relative to patent 3,313,504. The bag dispensing apparatus of P. Hagemeister includes an open horizontal frame for holding open the mouth of a bag with front vertical bars being suspended from the open frame and being fixedly attached thereto. A horizontal bar is mounted on the vertical bars below the frame and inclined members extend rearwardly and forwardly from the horizontal bar. The rearwardly extending member constitute a bed for a roll of sequentially connected bags. Rear vertical bars are fixed to and depend from the open frame which is not detachable from the same and a further horizontal bar is supported on the rear bars in spaced parallel relationship with the first mentioned horizontal bar to form a slot above the above-mentioned bed through which bags from the roll of sequentially connected bags supported on the bed can be passed.

None of the aforegoing apparatuses constitute a knock-down structure the parts of which can be nested in relatively flat and compact relationship so as to be accommodated in flat box which facilitates marketing and makes an effective and economic use of marketing space.

SUMMARY OF INVENTION

It is an object of the invention to provide improved structures for supporting bags in position for utilization and particularly for supporting plastic bags having handles thereon.

It is another object of the invention to provide an improved bag supporting apparatus which is of the knock-down structural type and which is capable of having its various parts arranged in flat nesting relationship for packaging in a box or other such container in such a manner as to conserve shelf space for purposes of efficient marketing.

Yet another object of the invention is to provide an improved bag supporting structure made of separable parts which are readily assembled and which are readily capable of being assembled and mounted by consumers.

Still another object of the invention is to provide improved bag supporting apparatus capable of being manufactured of plastic materials with mass production techniques and at relatively low costs.

Yet another object of the invention is to provide an improved bag supporting structure which is capable of supporting containers of replacement bags.

It is yet another object of the invention to provide an improved bag supporting apparatus which will appeal to the aesthetic values of prospective purchasers.

In achieving the above and other objects of the invention there is provided in accordance therewith a bag supporting apparatus which comprises spaced upright sides, preferably in parallel attitude , including upper and lower portions, these sides being adapted for being supported on a common supporting structure such as a cabinet door or the like. Further provided is a detachable open frame which couples the sides and which defines a mouth through which the bag depends. Such bags will be of the type having a peripheral margin adapted for being draped over the frame. Still further provided is a lower member extending between and detachable from the abovementioned sides and adapted for supporting a source of replacements bags as well as the bottom of the bag draped over the open frame. In addition there is provided in accordance with the invention a cover which is detachably coupled to the aforementioned upright sides in pivotal manner and which is in a position for selectively covering the mouth of the frame.

According to a feature of the invention and in the event that the bags include handles on the peripheral margins thereof there will be provided protrusions on the sides preferably in the form of tabs for engaging the handles of the bags.

It is a further feature of the invention to provide the cover, lower member, upright sides, and open frame of relatively flat construction, these parts being adapted when detached from one another to nest in a relatively flat compact assemblage thereby to enable effective and efficient use of marketing space.

More particularly the aforesaid frame comprises a plurality of sides connected in polygonal configuration and of generally inverted U-shaped cross-section. These sides have connected legs which are adapted to receive the upper portions of the upright sides. The frame includes two sides which are adapted to receive the upper portions of the upright sides and these two sides include upwardly open notches to permit the passage of one of the legs of a third of the sides of the frame. This third side serves to connect the above mentioned two sides of the frame.

As known the bags may be adapted for being closed by ties. To accommodate these ties at least one of the upright sides includes an upwardly open receptacle. The bag ties will preferably be in the form in elongated flat twistable members. To accommodate the upwardly extension of the ties from the receptacles provided therefor, U-shaped brackets will be superposed above the receptacles on the upright sides. These upright sides will moreover include pivots for engaging the cover.

According to a feature of the invention each of the upright sides includes a flange adapted to abut the aforesaid common supporting structure. These flanges may be provided with openings to accommodate a fastening element. Each such flange may moreover be provided with a recess in which is accommodated a tape having opposite adhesive faces for purposes of mounting.

As will be seen in the detailed description which follows hereinbelow, each upright side will preferably include a bottom perpendicular to the flange thereof. A hook will be provided on the flange defining a receptacle open towards but spaced from the aforementioned bottom. The bottom member of the apparatus will included portions resting against the bottoms of the upright sides and received in the receptacles defined by the above-mentioned hooks.

As will also be seen hereinbelow, the aforementioned portions include first and second orthogonally connected sections. The first sections rest against the flanges and are received in the receptacles defined by the hooks. The second sections rest against the aforementioned bottoms. The sides moreover include braces entrapping the second sections against the aforementioned bottoms.

Other features of the invention include without limitation that the lower member includes a tongue extending from the aforementioned portions and positioned below the mouth of the frame to support the bag positioned on the frame at any given time. Still another feature is that the lower member includes structure defining a receptacle between the aforementioned portions to accommodate a source of replacement bags.

The upright sides, frame, cover and lower member are preferably fabricated of plastic. It will be seen that the notches in the upright sides and the side of the frame and the leg thereof which is passed through the notches of the sides have corresponding sloped angles. It will also be seen that the frame and upright sides include corresponding male and female sections engaged in mating relation.

Other objects, features and advantages of the invention will be found in the detailed description which follow hereinbelow as illustrated in the accompanying drawing.

DETAILED DESCRIPTION

Plastic bags for the disposal of waste material are well known. They are fabricated for example of thin plastic film or the like which are frequently packaged in cardboard boxes or other similar containers for purposes of storage and ease of dispensing. These bags may be packed as separate units or may be sections of a roll which are readily separable from one another. It is also known that these bags are frequently provided with handles for purposes of carrying groceries or the like and that after being used for purposes of carrying groceries, such bags are frequently used to receive waste materials or garbage. Utilization of the handles of such bags aside from their use for carrying purposes is not known. They are however employed in accordance with features of the present invention.

Figure 1:
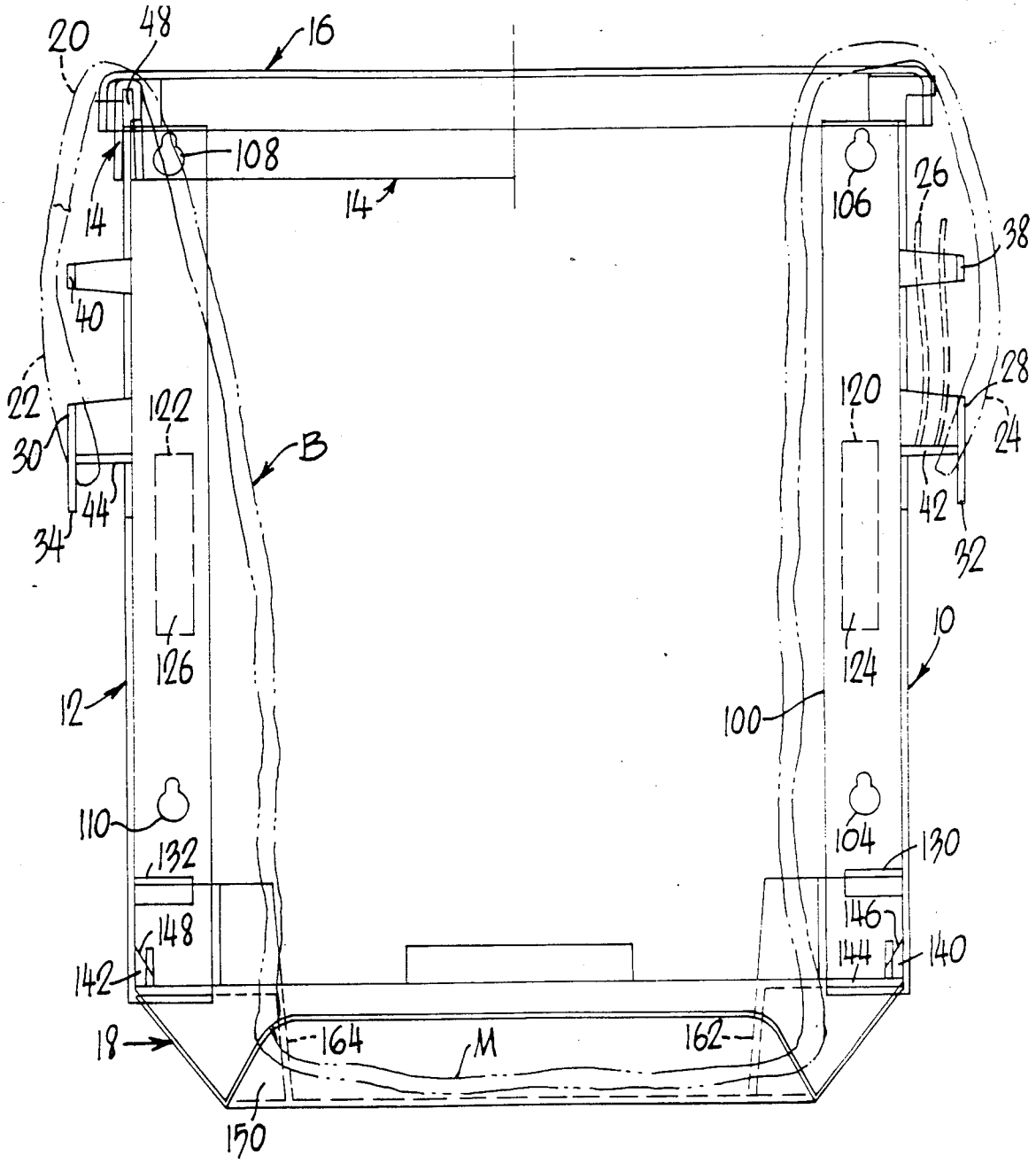
FIG. 1 is a front view of a bag supporting apparatus provided in accordance with the invention, a supported bag being shown in phantom lines.
Figures 2, 4:
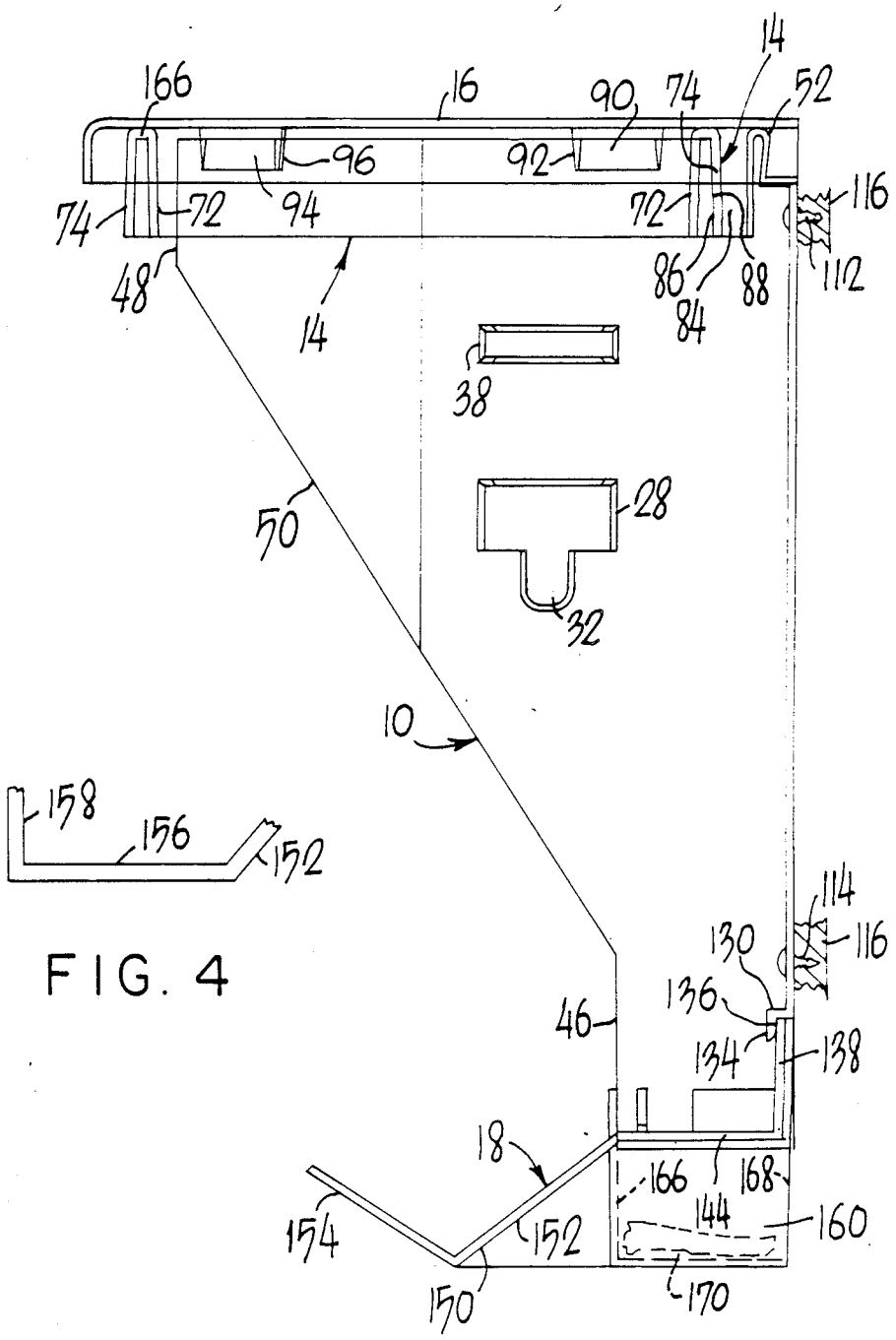
FIG. 2 is a side view of the structure of FIG. 1 with parts broken away and shown in dotted lines to reveal hidden structure.
FIG. 4 illustrates a modification of the structure illustrated in FIG. 2.
Figure 3:
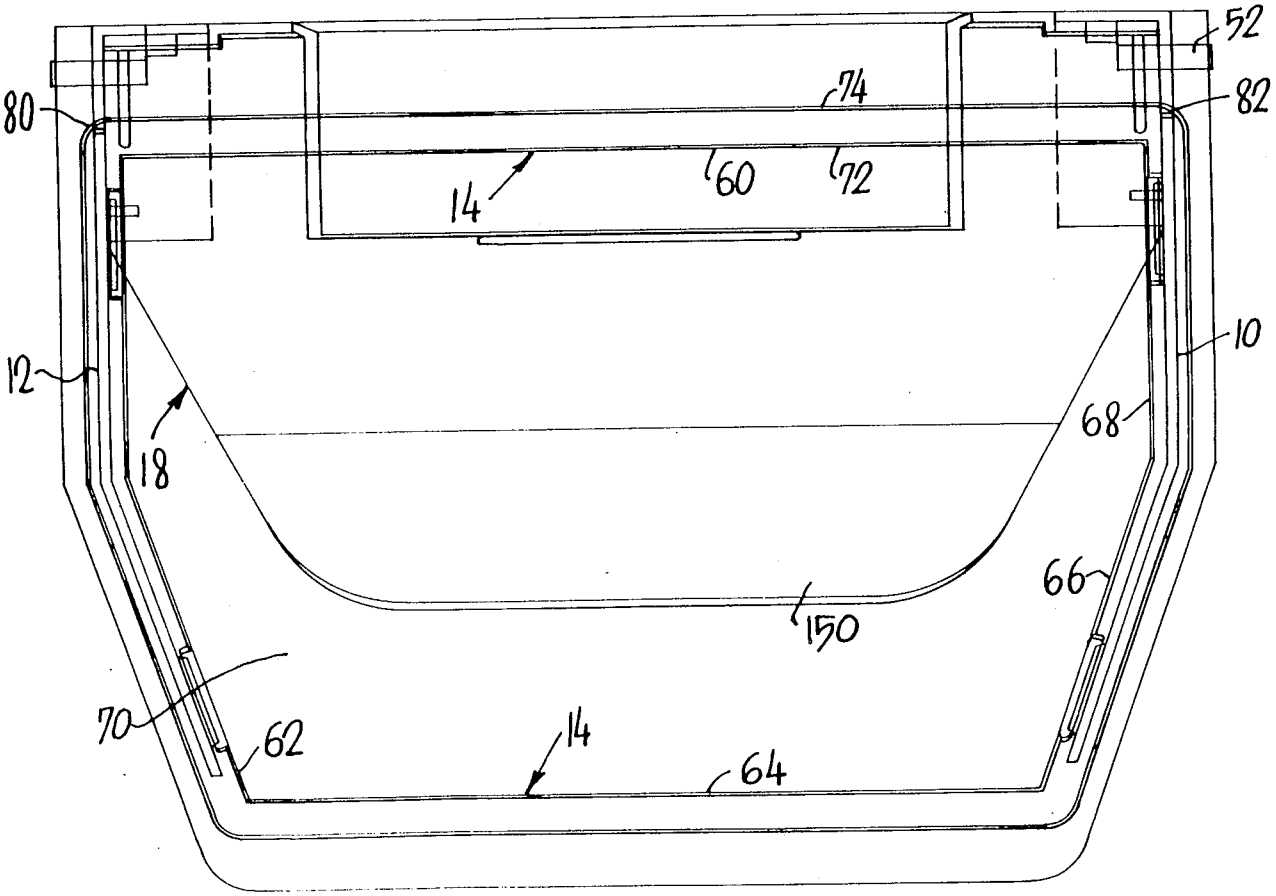
FIG. 3 is a top view of the structure of FIGS. 1 and 2.

In FIGS. 1–3 is shown a bag supporting apparatus provided in accordance with the invention. This apparatus is made of separate and detachable elements which are readily assembled to form the completed structure of the invention. These elements when separated from one another are of relatively flat construction and are capable of being packaged in flat compact nesting relationship in order to be received in a flat shallow box which is of a construction adapted for making effective and efficient use of marketing or shelf space.

Referring to FIGS. 1–3 it is seen that the bag supporting apparatus of the invention includes two upright sides 10 and 12. Also included is an open frame 14 and a cover 16. At the bottom of the apparatus of the invention is included a lower member 18.

The purpose of the bag supporting apparatus invention is to support a plastic bag or the like in position for utilization. A typical bag B is shown in lines phantom in FIG. 1. It includes a peripheral marginal portion 20 which is draped over the open frame 14. On the upper marginal portion 20 may be provided handles 22 and 24 in well known manner.

It is furthermore known that waste material such as garbage may be disposed of in bags supported in the manner indicated generally in FIG. 1. Also known is the fact that these bags can be sealed off or closed by the use of flat twistable ties having a wire core and of a configuration shown generally at 26 in FIG. 1. To accommodate these ties, a receptacle 28 is provided on side 10 whereas a receptacle 30 may be provided on side 12. Depending from these receptacles respectively are tabs or protrusions 32 and 34. These tabs or protrusions are of a shape such that the handles 22 and 24 may be looped over the same.

To accommodate the elongated extent of the ties 26 there are provided U-shaped brackets 38 and 40. These brackets are open and are superposed over the respective receptacles 28 and 30. The ties therefore seat against the bottoms 42 and 44 of the receptacles and extend upwardly through openings in the respective U-shaped brackets 38 and 40.

The upright sides have lower portions or legs 46 such as illustrated in FIG. 2 wherein is also indicated by way of example upper portion 48. Lower portion 46 and upper portion 48 are connected by a sloped edge 50. The cover 16 is coupled with the upper portion 48 of each upright side by means of a pivot pin 52 molded integrally with the respective supporting side therefor this side and all of its components being fabricated of a plastic such as polyethylene or polystyrene or the like. Similarly the cover 16, frame 14 and lower member 18 are fabricated of a like plastic. All of these elements are preferably provided with a highly polished and decorative surface which is readily cleaned.

As is best seen in FIG. 3, the open frame 14 is of generally polygonal conformation. The illustrated open frame includes sides 60, 62, 64, 66 and 68. These sides enclose a mouth 70 through which a draped bag will depend for support at the bottom M thereof against the lower member 18. Each side of the open frame 14 consists of an interior leg 72 and an outer leg 74. These legs will embrace the upright sides 10 and 12 at the upper portion 48 of the latter. The inner leg 72 of the open frame 14 will not intersect the structure of the sides 10 and 12 bearing as they do against the inner surfaces of the upright sides 10 and 12. The outer leg 74 of the open frame 14 will at 80 and 82 intersect and pass through the upright sides 10 and 12. For this purpose, a notch 84 is provided in each upright side as is best seen in FIG. 2. For facilitating mating relationship between the upper portion 48 of each upright side and the open frame, the upper portion of each upright side is provided with a sloped edge 86 whereas the inner surface of leg 74 is provided with a similar sloped surface indicated at 88. Moreover, the open frame and upper portion 48 of each upright side are provided with mating elements 90 and 92 and 94 and 96. One of these mating elements of each pair of mating elements is a protrusion and the other is a recess which snap together when the parts are in assembled relationship. Thus it will be seen that the side 60 of the open frame serves to connect the upright sides 10 and 12 with the mateable elements 90 and 92 and 94 and 96 providing for more firmly holding these elements together.

The upright sides 10 and 12 are provided with flanges 100 and 102, these flanges extending at right angles or orthogonally with respect to the upright sides 10 and 12. These flanges are provided with key-shaped openings 104, 106, 108 and 110. As is best seen in FIG. 2, these openings accommodate the passage of fastening members such as indicated at 112 and 114. These fastening members serve to support the sides 10 and 12 in a common supporting structure such as indicated at 116. This supporting structure may be the wall of a cabinet or the like.

The sides 10 and 12 are furthermore provided in flanges 100 and 102 with recesses 120 and 122. In these recesses are accommodated tapes with opposite adhesive faces. The tapes are indicated at 124 and 126. Tapes with double faces are commercially available and are available with such adhesive strength as to be able to support the weight of the bag supporting apparatus of the invention even when they accommodate waste laden bags and the like.

Each upright side is provided with a hook shaped structure 130 and 132. As best seen in FIG. 2, each hook shaped structure has a downwardly depending flange 134 which defines an internal receptacle 136 wherein is accommodated an upwardly extending portion 138 of the lower member 18. Each side is, moreover, provided with a protrusion 140 and 142 which serves to entrap a section 144 of the lower member 18 at opposite lateral extremities thereof. The sloped surfaces 146 and 148 provide for a snap fit of portions 144 beneath these protrusions 140 and 142.

The lower member 18 includes a tongue 150 protruding forwardly from the portion 144 thereof. The purpose of this tongue portion 150 is to accommodate the bottom of the bag B which is draped over the associated frame 14. The tongue 150 may include two angularly related sections 152 and 154. An alternative structure is illustrated in broken away fashion in FIG. 4 wherein appears section 152 and horizontally related section 156 along with toe section 158.

The lower member 18, moreover, includes a receptacle 160 defined by wall sections 162 and 164 along with wall section 166 and rear wall 168. This receptacle serves to accommodate a source of replacement bags shown generally at 170 in broken away fashion. This source of bags for replacement purposes may also be accommodated atop portion 144 of the lower member 18.

Legs 72 and 74 are angularly related and are connected together by a U-shaped bight as indicated at 166 in FIG. 2. This means that the frame consists of legs 72 and 74 which straddle in part the upper portions 48 of the upright sides 10 and 12. The open frame 14 is preferably a monolithic structure fabricated of plastic as indicated above. The U-shaped bight 166 serves to provide a surface facing upwardly upon which the cover 16 can rest when in a position serving to obturate the mouth 70 of the open frame as well as the mouth of the bag B draped thereover and suspended therefrom.

Figure 5:
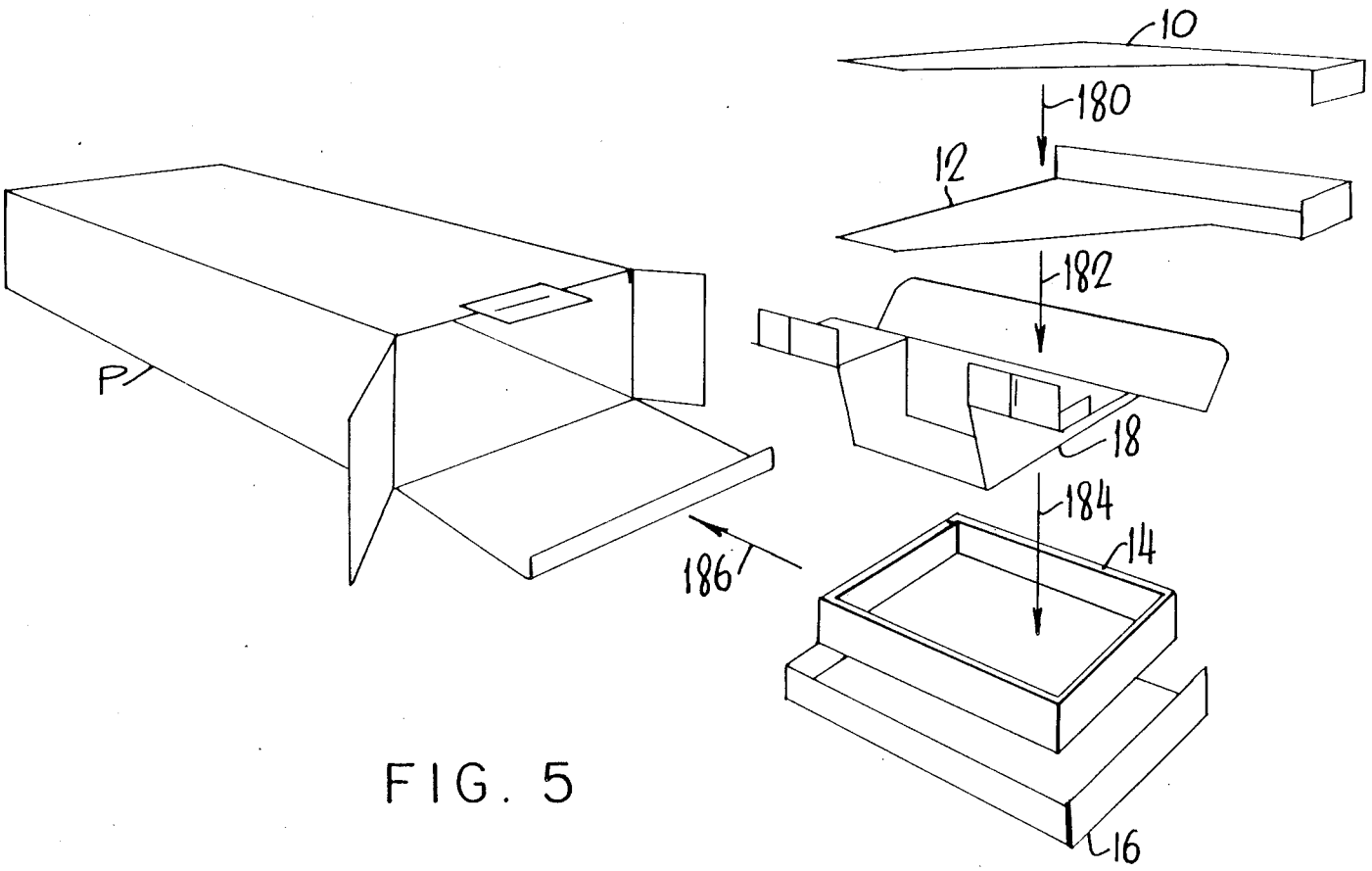
FIG. 5 is an exploded view showing the nesting relationship of the separate parts for packaging and marketing.

In FIG. 5 is shown a package or box P into which the parts of the strucure of the invention are fit in nesting relation. More particularly, sides 10 and 12, bottom member 18, open frame 14 and cover 16 are nested together as shown by arrows 180, 182 and 184 and are then inserted into box P as shown by arow 186. The box P which is flat and shallow is adapted for making effective efficient use of shelf marketing space.

There will now be obvious to those skilled in the art many modifications and variations of the structures set forth hereinabove. These modifications and variations will not depart from the scope of the invention if defined by the following claims.

What is claimed is:

1. A bag apparatus comprising spaced upright sides including upper and lower portions, said sides being adapted for being supported on a common supporting structure, a detachable open frame coupling said sides and defining a mouth through which said bag depends, said bag having a peripheral margin adapted for being draped over said frame, a lower member extending between and detachable from said sides and adapted for supporting a source of replacements for said bag said bag including handles on the peripheral margin thereof, protrusions on said sides for engaging said handles on said bag, and a cover detachably coupled to said sides in pivotal manner and in a position for selectively covering the mouth of said frame, said frame comprising a plurality of sides connected in polygonal configuration and of generally inverted U-shaped cross-section having connected legs, two of the sides of the frame being adapted to receive the upper portions of the upright sides, said two sides including upwardly open notches to pass one of the legs of a third of the sides of the frame, the third side connecting the two said sides of the frame.

2. A bag apparatus as claimed in claim 1 wherein said bags are adapted for being closed by respective bag ties and at least one of said upright sides includes an upwardly open receptacle for receiving and storing said bag ties.

3. A bag apparatus as claimed in claim 2 wherein the bag ties are elongated flat twistable members and said receptacle defines a storage chamber adapted to accommodate a plurality of said elongated flat members.

4. A bag apparatus as claimed in claim 2 wherein each of said upright sides includes one of said protrusion for engaging the handles of the bags.

5. A bag apparatus as claimed in claim 1, wherein the upright sides, frame, cover and lower member are of plastic.

6. A bag apparatus as claimed in claim 1 wherein the notches of said sides and the leg passed thereby have corresponding sloped angles.

7. A bag apparatus as claimed in claim 1 wherein the frame and upright sides include corresponding male and female means engaged in mating relation.

8. A bag apparatus as claimed in claim 4 wherein each of the upright sides includes one said receptacle and one said protrusion depending therefrom.

9. A bag apparatus as claimed in claim 8 comprising a U-shaped bracket on each said upright side and superposed above one of said receptacles.

10. A bag apparatus as claimed in claim 1 wherein each of said upright sides includes a pivot for engaging said cover.

11. A bag apparatus as claimed in claim 1 wherein each of said upright sides includes a flange adapted to abut said common supporting structure.

12. A bag apparatus as claimed in claim 11 wherein each said flange is provided with at least one opening to accommodate a fastening element.

13. A bag apparatus as claimed in claim 11, wherein each said flange is provided with a recess, comprising a tape in said recess with opposite adhesive faces.

14. A bag apparatus comprising spaced upright sides including upper and lower portions, said sides being adapted for being supported on a common supporting structure, a detachable open frame coupling said sides and defining a mouth through which said bag depends, said bag having a peripheral margin adapted for being draped over said frame, a lower member extending between and detachable from said sides and adapted for supporting a source of replacements for said bag,said bag including handles on the peripheral margin thereof, protrusions on said sides for engaging said handles on said bags, and a cover detachably coupled to said side in pivotal manner and in a position for selectively covering the mouth of said frame, each of said upright sides including a flange adapted to abut said common supporting structure, each said upright side including a bottom perpendicular to the flange thereof, said apparatus further comprising a hook on the flange defining a receptacle opening towards but spaced from said bottom, said lower member including portions resting against the bottoms and received in the receptacles defined by said hooks.

15. A bag apparatus as claimed in claim 14 wherein said portions includes first and second orthogonally connected sections, said first sections resting against the flanges, and being received in the receptacles defined by the hooks, said second sections resting against said bottoms, said upright sides including braces entrapping the second sections against the bottoms.

16. A bag apparatus as claimed in claim 14, wherein said lower member includes a tongue extending from said portions and positioned below the mouth of said frame to support the bag positioned on the frame.

17. A bag apparatus as claimed in claim 16, wherein said lower member includes means defining a receptacle between said portions to accommodate said source of replacement bags.

* * * * *